US006573818B1

(12) United States Patent
Klemmer et al.

(10) Patent No.: US 6,573,818 B1
(45) Date of Patent: Jun. 3, 2003

(54) PLANAR MAGNETIC FRAME INDUCTORS HAVING OPEN CORES

(75) Inventors: Timothy J. Klemmer, Pittsburgh, PA (US); Robert Bruce Van Dover, Maplewood, NJ (US); Kenneth Alexander Ellis, North Plainfield, NJ (US); Ashraf Wagih Lotfi, Rowlett, TX (US)

(73) Assignee: Agere Systems, Inc., Allentown, PA (US)

( * ) Notice: Subject to any disclaimer, the term of this patent is extended or adjusted under 35 U.S.C. 154(b) by 0 days.

(21) Appl. No.: 09/540,618

(22) Filed: Mar. 31, 2000

(51) Int. Cl.[7] ..... H01F 27/02
(52) U.S. Cl. ..... 336/83; 336/200
(58) Field of Search ..... 336/65, 83, 200, 336/223, 232; 257/531

(56) References Cited

U.S. PATENT DOCUMENTS 4,342,143 A * 8/1982 Jennings ..... 336/200
5,515,022 A * 5/1996 Tashiro et al. ..... 336/200

FOREIGN PATENT DOCUMENTS

JP 57-190305 * 11/1982
JP 6-69037 * 3/1994

* cited by examiner

*Primary Examiner*—Tuyen T. Nguyen
(74) *Attorney, Agent, or Firm*—Gibbons, Del Deo, Dolan, Griffinger & Vecchione

(57) ABSTRACT

The present invention is a planar spiral inductor a top magnetic layer a bottom magnetic layer; and a plurality of conductive coils disposed between said top magnetic layer and said bottom magnetic layer. A significant difference from prior art is that the top and bottom magnetic layers have their centers effectively cut out using lithographic techniques or other techniques to frame the core of the conductive spirals. An advantage of this structure over the prior art is that when magnetic anisotropies other than shape are kept small, then the magnetic configuration will produce a magnetostatic shape anisotropy such that the easy axis (low energy direction of magnetization) lies parallel to the legs of a rectangular frame or the circumference of a circular frame, as will be described. During operation of the inductor, the field produced by the coils flows in a radial direction and will be perpendicular to the easy axis direction thereby causing magnetization reversal to occur by rotation while advantageously utilizing the full structure in this mode.

10 Claims, 7 Drawing Sheets

PLANAR MAGNETIC FRAME INDUCTORS HAVING OPEN CORES

FIELD OF THE INVENTION

The present invention relates generally to thin film inductors and the articles comprising the structure therefor.

BACKGROUND OF THE INVENTION

With the increasing trend of miniaturization of electrical circuits, it is expected that thin film inductors will find applications in AC circuits such as those for on-chip power management and signal processing for wireless communications products. For example, inductors intended for power management will be required to operate in the 10 MHz region, have relatively large inductance and be able to handle large driving currents. For wireless communication applications, it is anticipated that ultra high frequency (>1 GHz) inductors will be utilized, where inductance and driving currents that are required are comparatively small relative to power management applications.

Currently, typical bulk inductors are made by wrapping conducting coils around a magnetic torroid. Often an air gap is put into the torroid to control the magnetic properties. The effect of the air gap is to manipulate the internal magnetic field ($H_i$) such that $$H_i = H_a - NM$$

where $H_a$, is the applied field, M is the magnetization of the ferromagnetic material and N is a demagnetizing constant which is dependent on the geometry of the gapped inductor. Because a structure will try and magnetize itself such that its internal magnetic field is zero, the magnetization increases linearly with an applied magnetic field such that the shape of a corresponding hysteresis loop becomes sheared with respect to an ungapped structure. This slanting of the hysteresis loop is also responsible for maximizing the energy storage of the inductor—since $E_{stored} = \frac{1}{2} L I_{max}^2$, where L is the inductance and $I_{max}$ is the maximum current of the coils. In addition, since $I_{max}$ is proportional to the maximum magnetic field ($H_{max}$) and L proportional to the permeability $$\left(\mu = \frac{\Delta B}{\Delta H}\right),$$

it can be seen that optimization of the energy storage occurs when $H_{max}$ is just below $H_{sat}$.

The geometry of planar inductors causes some magnetic effects which are dissimilar to magnetic effects found in bulk inductors. These differences must be considered when designing a planar inductor for maximum efficiency in the application of interest. For example, due to the shape anisotropy of thin films, magnetization typically is confined in the plane of the magnetic film, essentially causing a two dimensional magnetization reversal. Soft magnetic films which would be used for planar inductors typically have an additional in-plane uniaxial anisotropy energy, where the magnetization is of low energy when along the 'easy axis' and high energy when along the 'hard axis'. Since this energy which controls the magnetization reversal process is typically uniaxial, the easy axis is perpendicular to the hard axis. This causes the magnetization reversal to predominantly occur by magnetic domain wall motion when a field is applied parallel to the easy axis and by magnetization rotation when a field is parallel to the hard axis. Magnetization rotation produces a linear hysteresis loop with a saturating field equal to the anisotropy field ($H_k = 2K_u/M_s$) where $K_u$ is the uniaxial anisotropy constant. As is known, this uniaxial anisotropy can be produced in ferromagnetic films through different mechanisms such as uniaxial stress (magnetoelastic energy), magnetically induced anisotropy (an external magnetic field applied to the film during deposition or annealing), crystal anisotropy (when an in-plane crystallographic texture is present), tilted columnar microstructure (a micro magnetostatic energy) or as a result of the shape of a patterned magnetic structure (a macro magnetostatic energy). Because of the resulting linear hysteresis loop of magnetization rotation, the effect of increasing the uniaxial anisotropy is analogous to the effect of increasing the gap size in bulk torroids.

For ultra high frequency inductor applications it is also advantageous to have a uniaxial anisotropy in the ferromagnetic layers. It is also beneficial to operate the magnetization reversal by rotation mechanisms because rotation typically has higher ferromagnetic resonance frequencies and lower losses than domain wall motion mechanisms. This is especially important at ultra high frequencies. The ferromagnetic resonance frequency can be used to calculate a cut-off frequency for the usefulness of a magnetic inductor. The resonance frequency for magnetization rotation of a thin ferromagnetic film can be calculated to be $$fres = \frac{\gamma}{2\pi}\sqrt{Hk4\pi Ms}$$

where γ is the gyromagnetic constant.

$$\left(\frac{\gamma}{2\pi} \sim 2.8\ \mathrm{MHz/Oe}\right).$$

Theoretically the maximum permeability of rotation is given by $4\pi M_s/H_k$ as a first approximation. Again, the importance of controlling this anisotropy for the application and frequency of interest can be seen, since a large $H_k$ increases the resonance frequency. At the same time, however, large $H_k$ also decreases the permeability.

The prior work on the design of thin film inductors has focused primarily on the shape of the conducting coil. For example, Kawabe et al., IEEE Trans. Mag. V20, #5, p. 1804–1806 (1984) describes planar coils with hoop type, spiral type and meander type configurations. Sato et al, IEEE Trans. Mag. V30 #2,p.217–223 (1994) describes a double rectangular spiral coil. Most of these inductors utilize rectangular or square shaped magnetic films above and/or below the plane of the conducting coils. In their analysis Kawabe et al. assume a constant permeability and do not take into consideration an anisotropy in the magnetic layer. However, Sato et al. and Yamaguchi et al., presented at MMM Miami, Fla., November, 1998 treat a more realistic model which takes into account magnetically induced anisotropy produced by external magnetic fields which occur during processing or subsequent annealing.

An example of a prior art type of configuration for a planar inductor 10 is shown in FIG. 1. As shown, the planar inductor 10 comprises a top magnetic layer 12 and bottom magnetic layer 14 including, for example, magnetic film conductor coils 16 sandwiched between the two layers. Referring to FIG. 2, it can be seen that region A has an applied field parallel to the easy axis. Region B has the applied field parallel to the hard axis. As would be understood by a person skilled in the art, this means that region A will operate by domain wall motion mechanisms which are not beneficial for high frequency applications. This is because domain wall motion has higher losses and lower ferromagnetic resonating frequencies than rotation mechanisms. Region B would operate by magnetization rotation mechanisms which are the desired mechanism of magnetization reversal for high frequencies. Some prior art designs manipulate the dimensions of the magnetic layer in order to eliminate region A and as a result the complete coil is not utilized.

Another type of inductor described in prior art literature is the stripe inductor which involves a conductor sandwiched between two magnetic layers in the form of a stripe. For these inductors the magnetic material either completely encloses each segment of conductor or has the same width as each segment of conductor. The stripe inductor has been proposed for UHF applications and will contain a shape anisotropy which must be considered for device design as will be discussed. Based on the above, it can be seen that a need exists in the design of planar inductors which better takes into consideration the existence of the anisotropies of the magnetic layers.

SUMMARY OF THE INVENTION

The present invention is a planar spiral inductor including a top magnetic layer a bottom magnetic layer and a plurality of conductive coils disposed between the top magnetic layer and the bottom magnetic layer. A significant difference from prior art is that the top and bottom magnetic layers have their centers effectively cut out using lithographic techniques or other techniques to frame the core of the conductive spirals. An advantage of this structure over the prior art is that when magnetic anisotropies other than shape are kept small, the magnetic configuration will produce a magnetostatic shape anisotropy such that the easy axis (low energy direction of magnetization) lies parallel to the legs of a rectangular frame or the circumference of a circular frame. During operation of the inductor, the field produced by the coils flows in a radial direction and will be perpendicular to the easy axis direction thereby causing magnetization reversal to occur by rotation while advantageously utilizing the full structure in this mode.

BRIEF DESCRIPTION OF THE DRAWINGS

For a better understanding of the present invention, reference is made to the following description of an exemplary embodiments thereof, considered in conjunction with the accompanying drawings, in which.

DETAILED DESCRIPTION

The present invention is a planar spiral inductor having some structural characteristics that are common with inductors in the prior art. A significant difference from prior art, however, is that the top and bottom magnetic layers have their centers effectively cut out using lithographic techniques or other techniques to frame the core of the conductive spirals. An advantage of this structure over the prior art is that when other magnetic anisotropies are kept small, then the magnetic configuration will produce a magnetostatic shape anisotropy such that the easy axis (low energy direction of magnetization) lies parallel to the legs of a rectangular frame or the circumference of a circular frame, as will be described. During operation of the inductor, the field produced by the coils flows in a radial direction and will be perpendicular to the easy axis direction thereby causing magnetization reversal to occur by rotation while advantageously utilizing the full structure in this mode.

Figure 1:
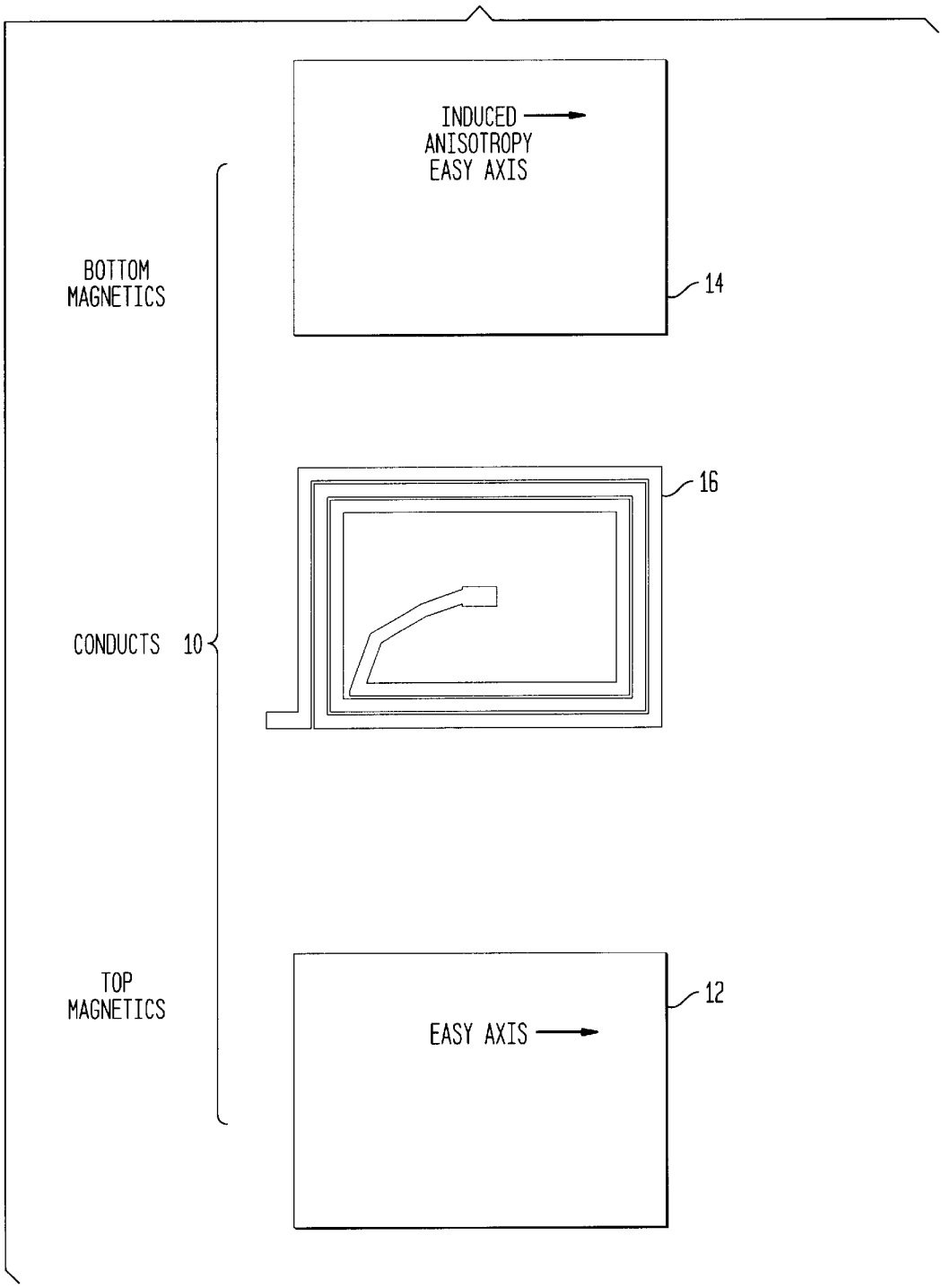
FIG. 1 (PRIOR ART)
FIG. 1 is prior art representation of a planar inductor.
Figure 2:
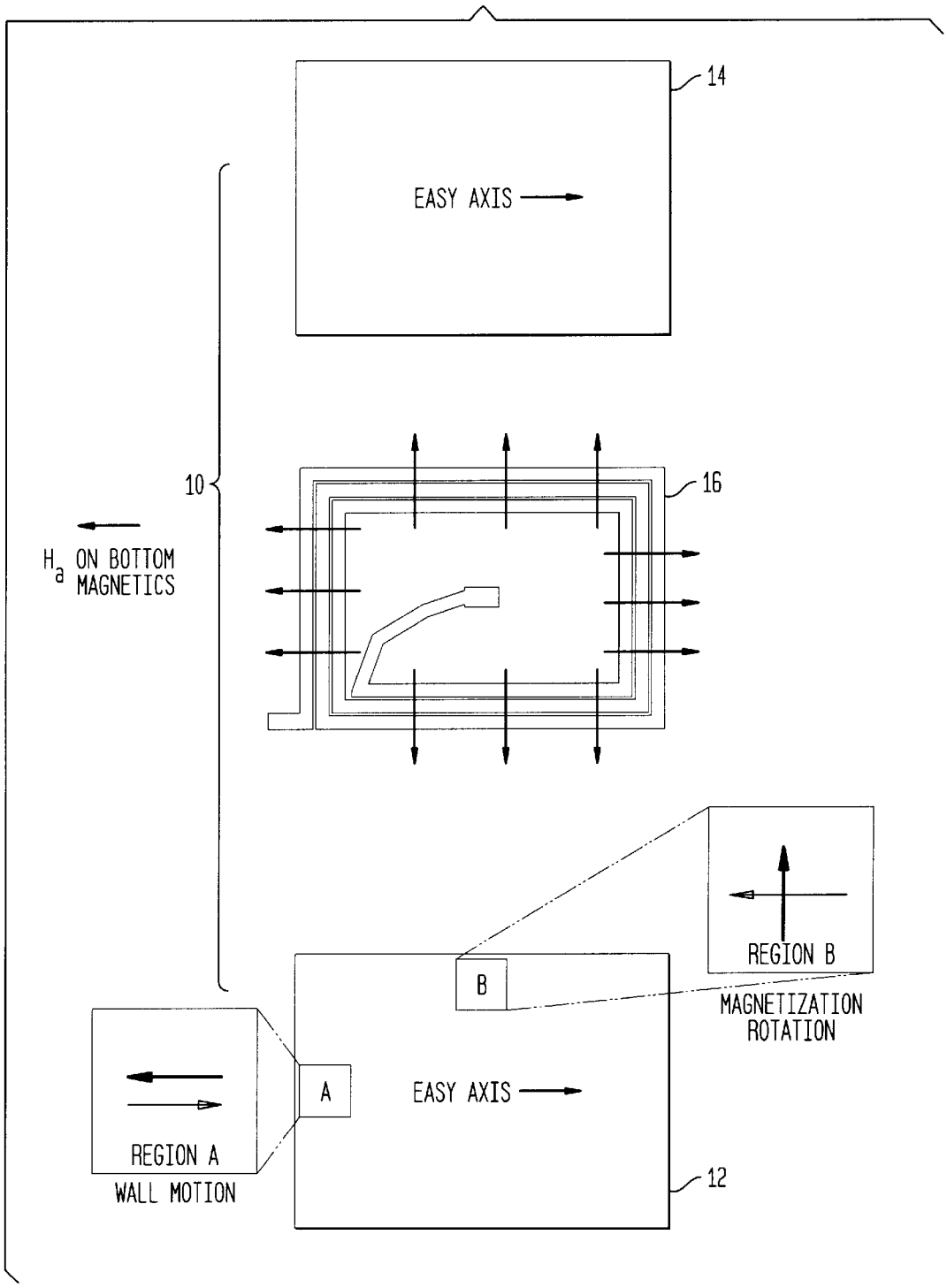
FIG. 2 (PRIOR ART)
FIG. 2 is another representation of a planar inductor of the prior art which illustrates certain effects of magnetic anisotropies on such a device.
Figure 3:
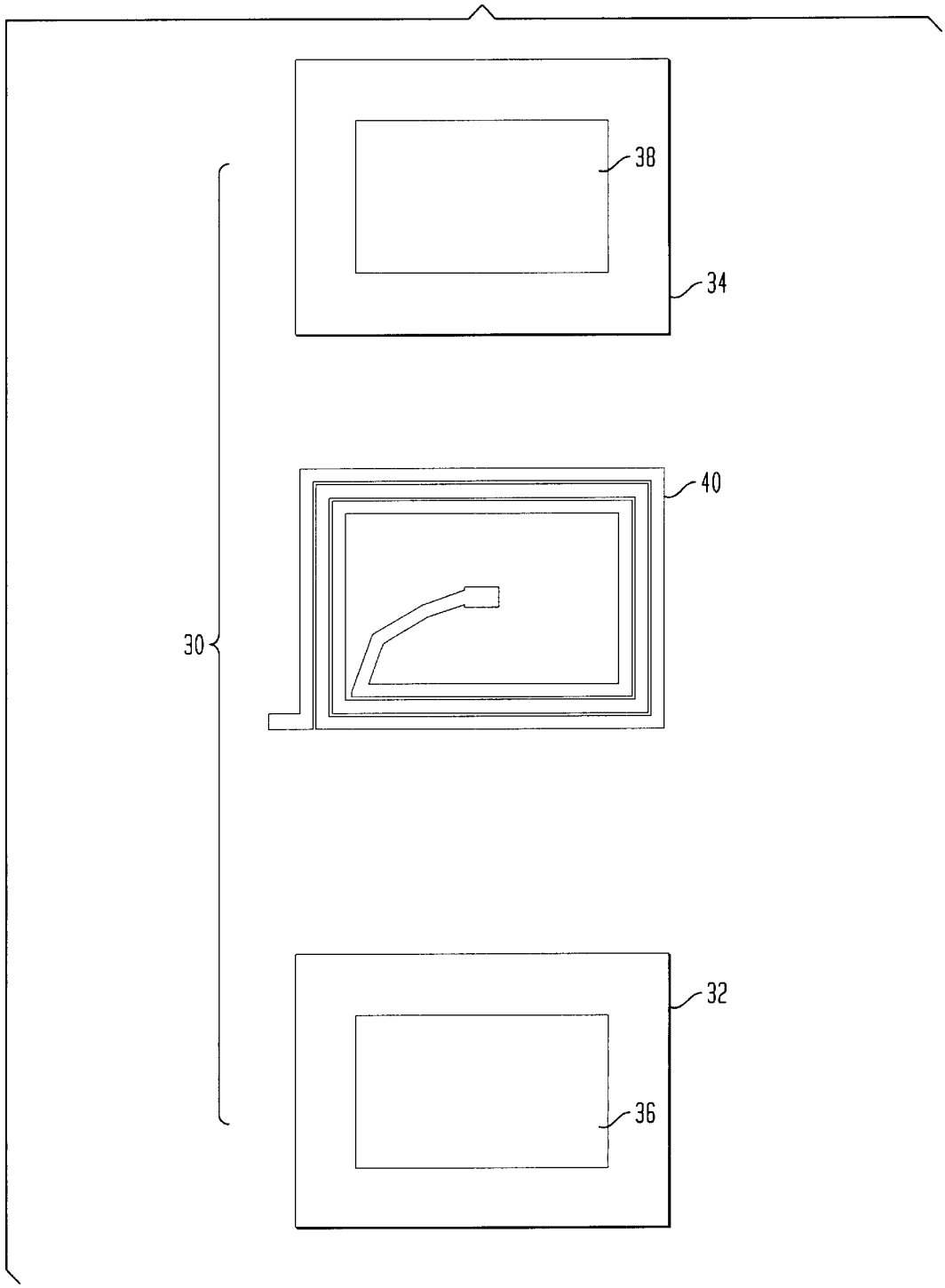
FIG. 3 is a representation of a planar inductor device in accordance with the present invention.

By way of example only, a simple model of a spiral inductor will be discussed in order to illustrate the advantage of the present invention over the prior art. Referring to FIG. 3, an exemplary embodiment of a planar inductor 30 in accordance with the present invention is shown. The planar inductor 30 includes a top magnetic layer 32 and bottom magnetic layer 34 each having their respective center regions 36, 38 cut out. A conductor region 40 (illustrated as a spiral) is shown located in between the top and bottom layers 32, 34.

Figure 4A:
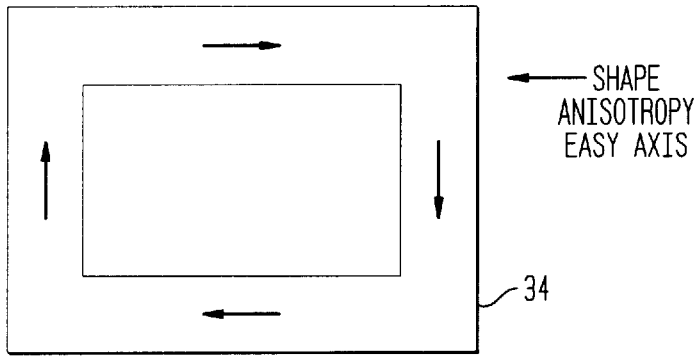
FIGS. 4A, 4B and 4C show another representation of a planar inductor in accordance with the present invention and illustrates certain effects of magnetic anisotropies on-such a device.
Figure 4B:
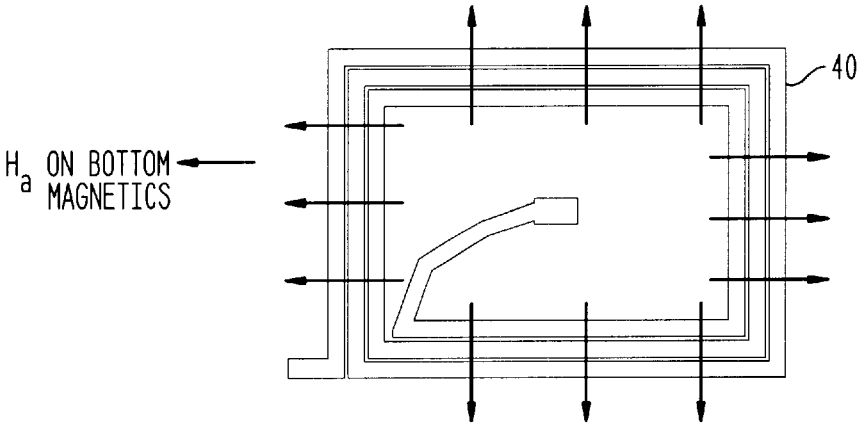
Figure 4C:
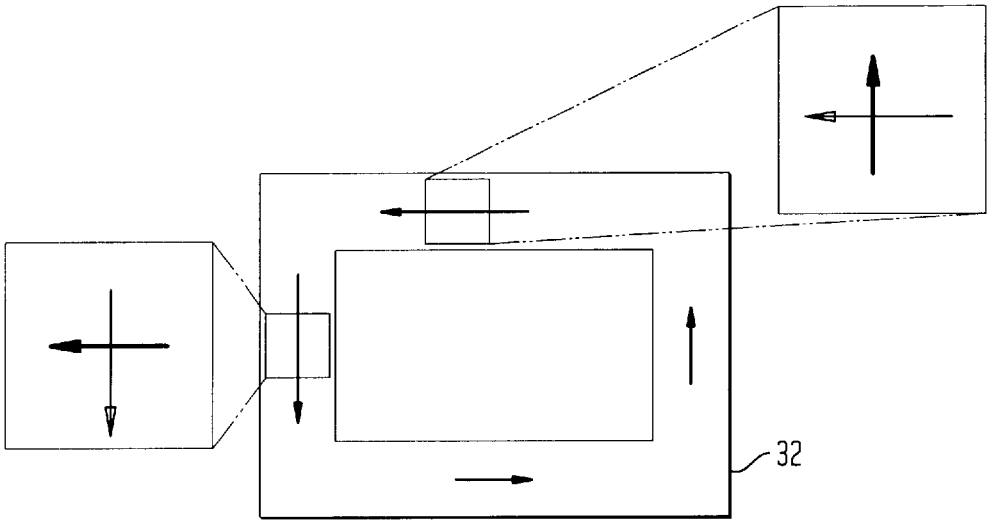

As a first approximation the top and bottom magnetic layers 32, 34, each resembling a picture frame, can be treated as a thin doughnut, if the corners are neglected. If it is also assumed that all other anisotropies, except shape anisotropy, are zero for the thin doughnut magnetic layer, then the magnetostatic energy is minimized when the magnetization is parallel to the circumference of the thin doughnut/picture frame magnetic layers 32, 34 as shown in FIG. 4A. This direction (represented by the arrows) is then the easy direction of magnetization. The sandwiching of a spiral 40 between two magnetic doughnuts (top and bottom magnetic layers 32, 34) will cause the applied field to be perpendicular to this shape anisotropy easy axis at all positions in the magnetic loop as shown in FIG. 4B. This will cause the magnetization reversal to be by the desired rotation mechanisms as shown in FIG. 4C.

Figure 5:
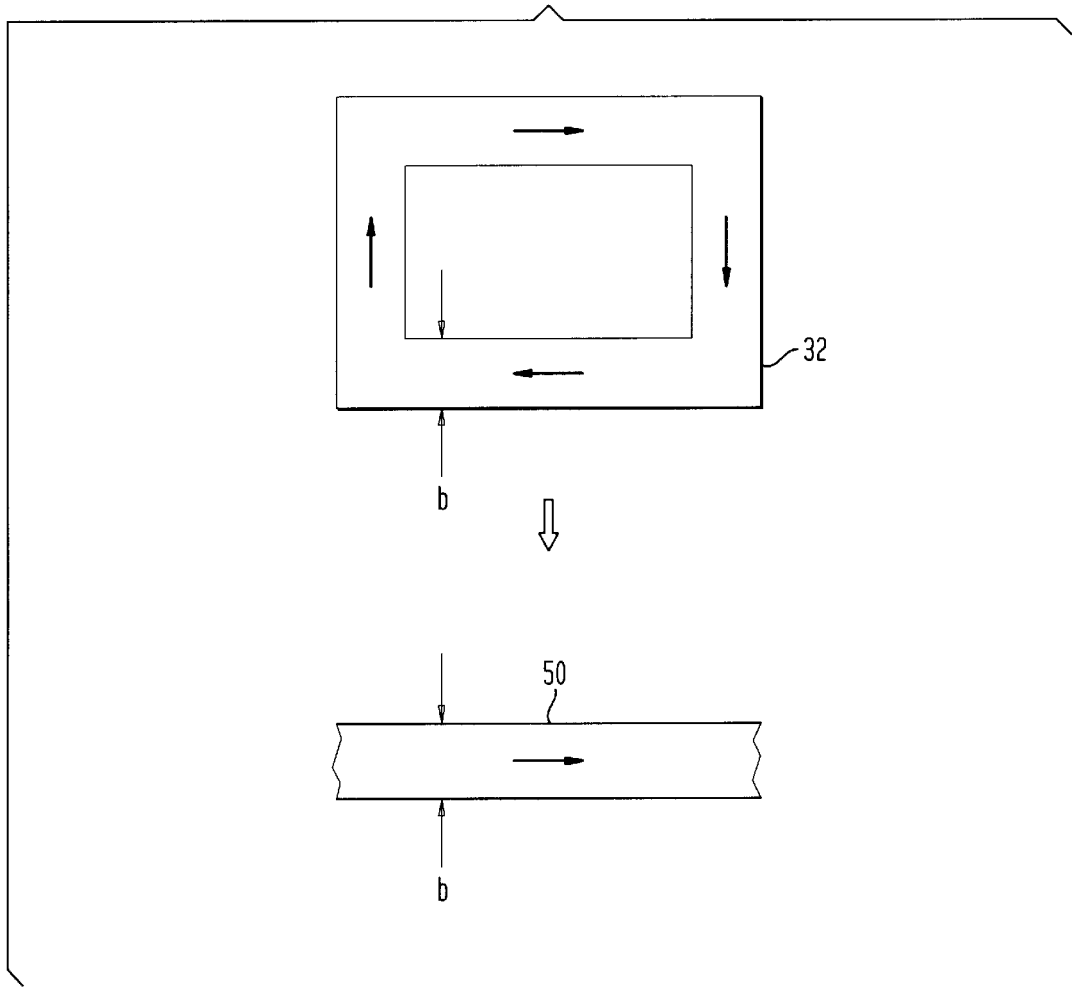
FIG. 5 illustrates the treatment of a planar inductor of the present invention as an infinitely long stripe inductor.

In order to calculate the shape anisotropy of a thin magnetic doughnut one must realize that when the magnetization is parallel to the circumference, no free magnetic poles are produced at the surfaces meaning that the magnetostatic energy is zero ($N_a$=0). This means that as a first approximation, the doughnut layer 32 can be unraveled and the problem treated as an infinitely long stripe 50 as shown in FIG. 5. As would be understood by a person skilled in the art, the demagnetizing field produced perpendicular to the shape anisotropy easy axis of a rod or stripe can be estimated by $$H_d = N_b \cong 4\pi M(t/b)\left(\frac{a}{b}\right)\left(1+\frac{a}{b}\right)^{-1}$$

where t is the thickness, b is the width and a the length of the stripe. When a>>b then:

$$H_d = N_b \cong 4\pi M(t/b)$$

and the internal field becomes:

$$H_i = H_a - H_d$$

The net magnetization increases linearly with field until $H_a = H_d$, similar to the gapped bulk inductors.

Another way to look at this situation is to consider the magnetostatic anisotropy energy given by $$Ems=Ks\sin^{2\theta}=2\pi(t/b)M^2\sin^2\theta$$

where θ is the angle that the magnetization makes with the easy axis (parallel to the circumference of the doughnut or the length of the stripe). The anisotropy field $H_k$ can be calculated from $$H_k = \frac{2K_s}{M_s}$$

where $$K_S = \frac{1}{2}(N_b - N_a)M^2.$$

Figure 6:
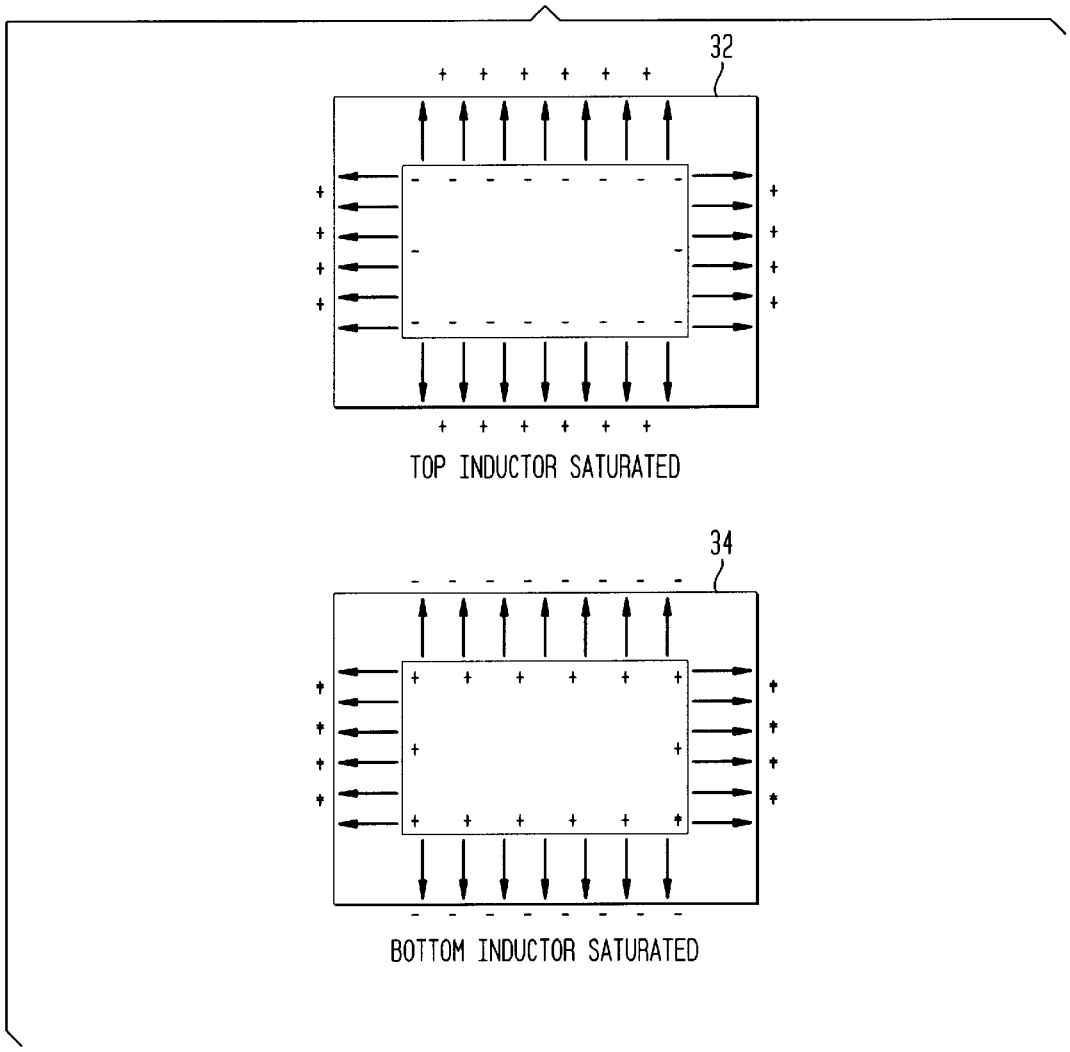
FIG. 6 illustrates the effect of a magnetic field applied to a planar inductor of the present invention.

In an analogous fashion to using the size of the air gap in bulk inductors to control the hysteresis loop, thickness and width (t/b) can be used to control the skew of the hysteresis loop of planar inductors. This is also true for long stripe inductors. However, the presence of two magnetic layers sandwiching the conductors causes the magnetization of the top and bottom magnetic layers to rotate in an opposite direction when the magnetic field is applied by the conductor as shown in FIG. 6 for half an AC cycle. This will decrease the calculated magnetostatic energy depending on the distance between magnetic layers.

If the magnetic material is deposited directly into the shape of the device then the magnetization should orient itself in low energy configurations. Therefore, alignment will occur with the magnetization parallel to the circumference as long as external fields during deposition are kept below the demagnetizing field. This will cause the magnetically induced anisotropy to be in the same direction as the shape anisotropy such that $H_k^{tot}=H_k^{shape}+H_k^{ind}$. However, complete realization of $H_k$ may not be realized during deposition since the demagnetizing field increases with thickness. Therefore, post-deposition annealing at low temperatures may be required to help reorient the induced anisotropy. Also when the magnetic material is deposited as a blanketed material and then patterned into a final shape, a post-deposition annealing again may be required.

Figure 7:
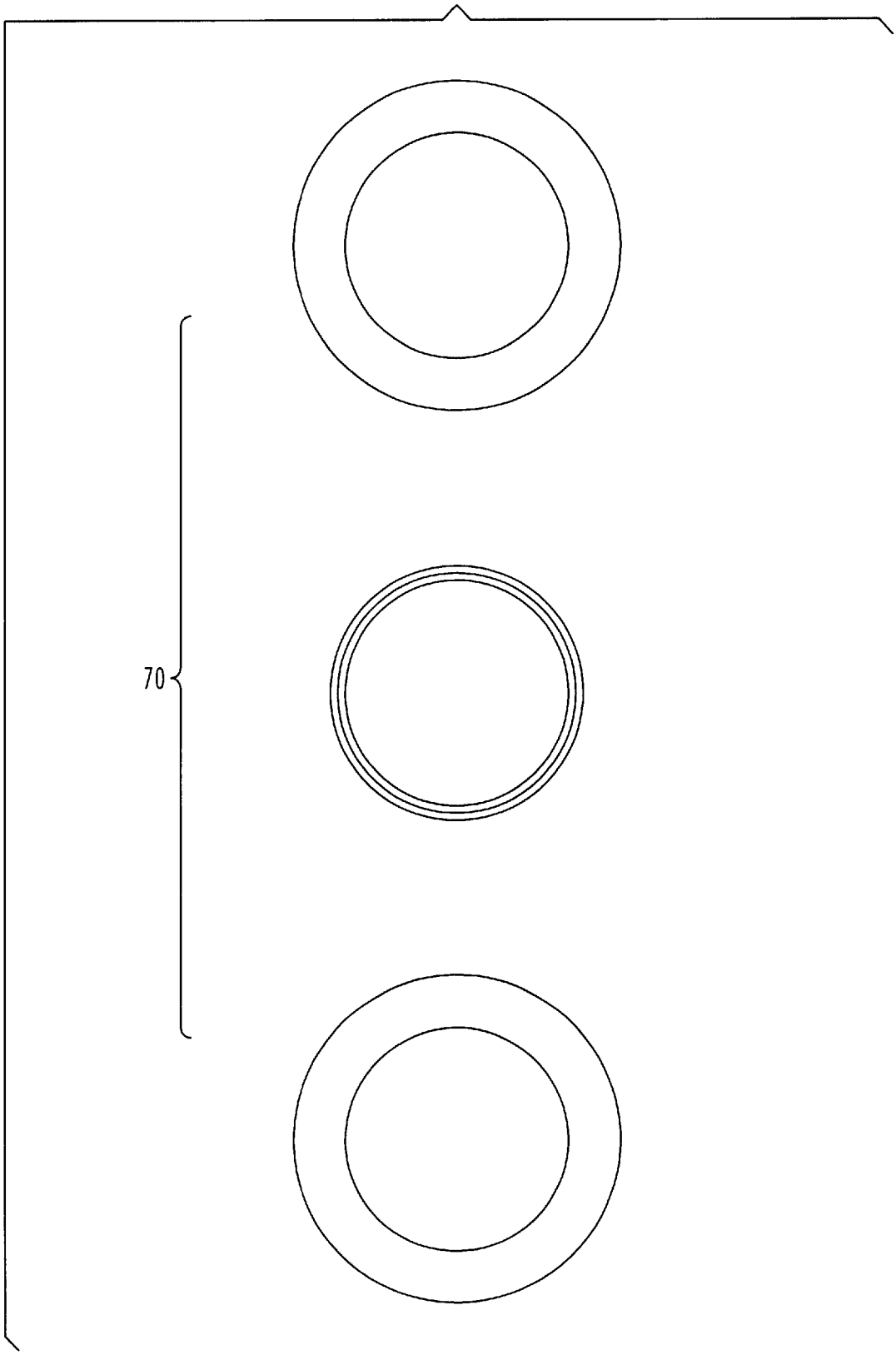
FIG. 7 illustrates the another embodiment of a planar inductor in accordance with the present invention.

It will be understood that the embodiment of the present invention system and method specifically shown and described is merely exemplary and that a person skilled in the art can make alternate embodiments using different configurations and functionally equivalent components. For example, FIG. 7 illustrates a planar inductor 70 in accordance with the present invention having a generally circular shape. All such alternate embodiments are intended to be included in the scope of this invention as set forth in the following claims.

What is claimed is:

1. A generally planar inductor device, comprising:

a top magnetic layer;

a bottom magnetic layer; and a plurality of conductive coils disposed between said top and bottom magnetic layers, each of said top and bottom magnetic layers having an inner circumference parallel to an outer circumference, a width between the inner and outer circumferences being substantially smaller than the inner circumference, wherein said conductive coils produce a magnetic field flowing in a radial direction thereof.

2. The device of claim 1, wherein said top and bottom magnetic layer define an open core in said inductor device.

3. The device of claim 1, wherein said top and bottom magnetic layer are magnetic films.

4. The device of claim 1, wherein said top and bottom magnetic layers and said conductive coils are generally rectangular in shape.

5. The device of claim 1, wherein said top and bottom magnetic layers and said conductive coils are generally circular in shape.

6. The device of claim 1, wherein said conductive coils define a configuration selected from the group consisting of hoop type and spiral type.

7. A generally planar inductor device, comprising:

a top magnetic film layer;

a bottom magnetic film layer; and a plurality of conductive coils disposed between said top and bottom layers, each of said top and bottom magnetic layers having an inner circumference parallel to an outer circumference, a width between the inner and outer circumferences being substantially smaller than the inner circumference, wherein said top and bottom layers define an open center region therein, said top and bottom layers frame said conductive coils to produce a magnetostatic shape anisotropy on said top and bottom layers such that a low energy direction of magnetization lies parallel to circumferences of said top and bottom layers.

8. The device of claim 7, wherein said top and bottom magnetic layers and said conductive coils are generally rectangular in shape.

9. The device of claim 7, wherein said top and bottom magnetic layers and said conductive coils are generally circular in shape.

10. The device of claim 7, wherein said conductive coils define a configuration selected from the group consisting of hoop type, spiral type and meander type.

* * * * *